United States Patent [19]

Hashimoto et al.

[11] 4,451,545

[45] May 29, 1984

[54] ELECTROPHOTOGRAPHIC ELEMENT WITH CARBAZOLE DERIVATIVE

[75] Inventors: Mitsuru Hashimoto; Kiyoshi Sakai, both of Numazu, Japan

[73] Assignee: Ricoh Co., Ltd., Tokyo, Japan

[21] Appl. No.: 422,401

[22] Filed: Sep. 23, 1982

[30] Foreign Application Priority Data

Oct. 3, 1981 [JP] Japan ..... 56-157883

[51] Int. Cl.[3] ..... G03G 5/06; G03G 5/14

[52] U.S. Cl. ..... 430/59; 430/58; 430/79; 548/440; 548/445

[58] Field of Search ..... 430/58, 79, 59; 542/454

[56] References Cited

U.S. PATENT DOCUMENTS 4,072,519 2/1978 Pearson et al. ..... 430/79 X
4,091,208 5/1978 Okazaki et al. ..... 430/79 X
4,415,641 11/1983 Goto et al. ..... 430/58 X

FOREIGN PATENT DOCUMENTS 1337228 11/1973 United Kingdom ..... 430/58

*Primary Examiner*—Roland E. Martin, Jr.
*Attorney, Agent, or Firm*—Flynn, Thiel, Boutell & Tanis

[57] ABSTRACT

An electrophotographic element comprising an electrically conductive substrate and a photosensitive layer, superposed thereon, containing a carbazole derivative compound having the following general formula (I):

(wherein R is a lower alkyl group or a benzyl group; X is a hydrogen atom, a lower alkyl group, a lower alkoxy group, a halogen atom, a nitro group, an amino group or a lower alkyl group- or benzyl group-substituted amino group; and n is an integer such as 1 or 2).

18 Claims, 3 Drawing Figures

ELECTROPHOTOGRAPHIC ELEMENT WITH CARBAZOLE DERIVATIVE

BACKGROUND OF THE INVENTION (a) Field of the Invention

The present invention relates to an electrophotographic element, in particular an electrophotographic element containing a specific carbazole derivative in a photosensitive layer.

(b) Description of the prior art

Inorganic substances such as selenium, cadmium sulfide, zinc oxide, etc. have hitherto been utilized as photoconductive materials for use in elements in electrophotographic processes. In this connection, it is to be noted that the "electrophotographic process" referred to herein generally denotes one of the image forming methods which comprise the steps of first electrifying a photoconductive element in the dark for instance with corona discharge or the like, then subjecting same to imagewise exposure of light for selectively dissipating the charge from only the light-stuck portions of the element to thereby form a latent image, developing the thus formed latent image with an electroscopic fine powder (toner) comprising a coloring agent such as dye, pigment or the like and a binder such as a high molecular substance or the like, rendering the latent image visible, and forming a visible image.

The element adapted for the above-mentioned electrophotographic process is required to possess the following fundamental characteristics: (1) capability of being charged with a suitable potential in the dark, (2) low discharge rate in the dark, (3) rapid dischargeability upon light radiation, and the like.

Generally speaking, the hitherto utilized inorganic substances as enumerated above surely possess a number of merits but at the same time possess various demerits. For instance, the now universally utilized selenium can satisfy the aforesaid requirements (1) to (3) to a sufficient degree, but is defective in that it is difficult to manufacture and consequently the manufacturing cost is high. In addition, the selenium is defective in that it is difficult to process the selenium, which lacks flexibility, into a belt, and close attention must be paid in handling the selenium which is very sensitive to heat and mechanical impacts, and the like. On the other hand, the cadmium sulfide and zinc oxide are utilized in the element in the manner of dispersing them in a binder resin. However, such element lacks the mechanical characteristics such as smoothness, hardness, tensile strength, frictional resistance and the like and therefore such element per se can not stand repeated use.

In recent years, electrophotographic elements employing various organic substances have been proposed in order to remove the inherent drawbacks in the inorganic substances as enumerated above, and some of them are put to practical use. Therein are included for instance the element comprising poly-N-vinylcarbazole and 2,4,7-trinitrofluorene-9-one (disclosed in U.S. Pat. No. 3,484,237), the element comprising sensitizing poly-N-vinylcarbazole with a pyrlium salt pigment (Japanese Patent Publication No. 25658/1973); the element comprising an organic pigment as the principal ingredient (Japanese Laid Open Patent Application No. 37543/1972), the element comprising a cocrystalline complex consisting of dye and resin as the principal ingredient (Japanese Laid Open Patent Application No. 10735/1972) and the like. However, the fact is that these elements are surely considered to possess superior characteristics as well as high practicality, but, when taking into consideration various requirements for elements used in the electrophotographic process, they can not meet these requirements yet to a satisfactory degree.

In this connection, however, it may be said that the elements enumerated up to now can generally exhibit superior characteristics by incorporating high-efficient photoconductive materials therein, though there exist differences in degree therebetween depending on their objects or manufacturing processes.

SUMMARY OF THE INVENTION

The primary object of the present invention is to provide an electrophotographic element capable of eliminating various drawbacks inherent in the previously stated conventional electrophotographic elements and satisfying various requirements asked for in the electrophotographic process in full degree. Another object of the present invention is to provide an electrophotographic element that can be manufactured easily as well as at a relatively low manufacturing cost and is also superior in durability.

We have carried out a series of studies and investigations in order to attain the above objects to discover that the carbazole derivative compound having the following general formula (I) acts effectively as the photoconductive material for electrophotographic elements and at the same time exhibits a superior performance as the charge transfer substance therefor:

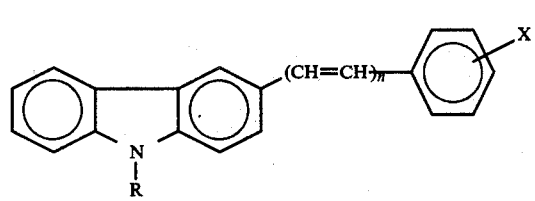

(wherein R is a lower alkyl group or a benzyl group; X is a hydrogen atom, a lower alkyl group, a lower alkoxy group, a halogen atom, a nitro group, an amino group or a lower alkyl group- or benzyl group-substituted amino group; and n is an integer such as 1 or 2.). In addition, we have discovered that this carbazole derivative compound, as referred to afterwards, can be combined with various materials to thereby provide elements which can exhibit unexpected superior results. The present invention has been completed on the basis of these findings.

To sum up, the electrophotographic element according to the present invention comprises an electrically conductive substrate and a photosensitive layer superposed thereon and is characterized in that said photosensitive layer contains a carbazole derivative having the above mentioned general formula (I) therein.

DETAILED DESCRIPTION OF THE PREFERRED EMBODIMENTS

Figure 1:
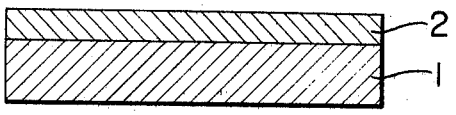
FIGS. 1 to 3 are sectional views illustrating three typical examples of elements embodying the present invention, wherein reference numeral 1 denotes an electrically conductive substrate, 2, 2', 2'' each denotes a photosensitive layer, 3 denotes a charge carrier generating material, 4 denotes a charge transfer medium or charge transfer layer, and 5 denotes a charge carrier generating layer.

As stated previously, the present invention relates to the electrophotographic element wherein the photosensitive layer contains a carbazole derivative having the general formula (I).

The above mentioned carbazole derivative compound having the general formula (I) used in the present invention can be obtained by reacting a phenyl derivative having the following general formula (II):

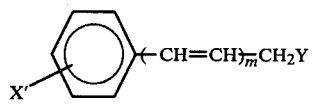

(II)

[wherein X' is a hydrogen atom, a lower alkyl group, a lower alkoxy group, a halogen atom or a nitro group; m is an integer such as 0 or 1; Y is a triphenylphosphonium group having the formula

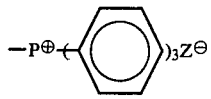

(wherein $Z^{\ominus}$ is a halogen ion) or a dialkyl phosphite group having the formula $—PO(OR')_2$ (wherein R' is a lower alkyl group)] with an aldehyde derivative having the following general formula (III):

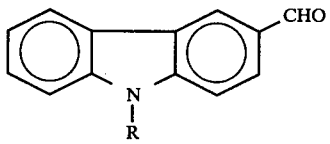

(III)

(wherein R is a lower alkyl group or benzyl group). In this connection, it is to be noted that the compound having the general formula (I) wherein X is an amino group or an lower alkyl group- or benzyl group-substituted amino group can be obtained by reducing the compound having the general formula (I) wherein X is a nitro group resultant from the above synthetic method or further alkylating or benzylating same as occasion demands.

The carbazole derivative compounds having the general formula (I) can be enumerated as follows.

| Compound No. | n | R | X |
|---|---|---|---|
| 1 | 1 | $—CH_3$ | —H |
| 2 | 1 | $—CH_3$ | 2-$CH_3$ |
| 3 | 1 | $—CH_3$ | 3-$CH_3$ |
| 4 | 1 | $—CH_3$ | 4-$CH_3$ |
| 5 | 1 | $—CH_3$ | 2-$C_2H_5$ |
| 6 | 1 | $—CH_3$ | 3-$C_2H_5$ |
| 7 | 1 | $—CH_3$ | 4-$C_2H_5$ |
| 8 | 1 | $—CH_3$ | 2-$(CH_2)_2CH_3$ |
| 9 | 1 | $—CH_3$ | 3-$(CH_2)_2CH_3$ |
| 10 | 1 | $—CH_3$ | 4-$(CH_2)_2CH_3$ |
| 11 | 1 | $—CH_3$ | 4-$CH(CH_3)_2$ |
| 12 | 1 | $—CH_3$ | 2-$(CH_2)_3CH_3$ |
| 13 | 1 | $—CH_3$ | 3-$(CH_2)_3CH_3$ |
| 14 | 1 | $—CH_3$ | 4-$(CH_2)_3CH_3$ |
| 15 | 1 | $—CH_3$ | 4-$CH_2CH(CH_3)_2$ |
| 16 | 1 | $—CH_3$ | 4-$CH(CH_3)CH_2CH_3$ |

-continued

| Compound No. | n | R | X |
|---|---|---|---|
| 17 | 1 | $—CH_3$ | 4-$C(CH_3)_3$ |
| 18 | 1 | $—CH_3$ | 2-$OCH_3$ |
| 19 | 1 | $—CH_3$ | 3-$OCH_3$ |
| 20 | 1 | $—CH_3$ | 4-$OCH_3$ |
| 21 | 1 | $—CH_3$ | 2-$OC_2H_5$ |
| 22 | 1 | $—CH_3$ | 3-$OC_2H_5$ |
| 23 | 1 | $—CH_3$ | 4-$OC_2H_5$ |
| 24 | 1 | $—CH_3$ | 4-$O(CH_2)_2CH_3$ |
| 25 | 1 | $—CH_3$ | 4-$O(CH_2)_3CH_3$ |
| 26 | 1 | $—CH_3$ | 2-Cl |
| 27 | 1 | $—CH_3$ | 3-Cl |
| 28 | 1 | $—CH_3$ | 4-Cl |
| 29 | 1 | $—CH_3$ | 2-Br |
| 30 | 1 | $—CH_3$ | 3-Br |
| 31 | 1 | $—CH_3$ | 4-Br |
| 32 | 1 | $—CH_3$ | 2-$NO_2$ |
| 33 | 1 | $—CH_3$ | 3-$NO_2$ |
| 34 | 1 | $—CH_3$ | 4-$NO_2$ |
| 35 | 1 | $—CH_3$ | 2-$NH_2$ |
| 36 | 1 | $—CH_3$ | 3-$NH_2$ |
| 37 | 1 | $—CH_3$ | 4-$NH_2$ |
| 38 | 1 | $—CH_3$ | 2-$N(CH_3)_2$ |
| 39 | 1 | $—CH_3$ | 3-$N(CH_3)_2$ |
| 40 | 1 | $—CH_3$ | 4-$N(CH_3)_2$ |
| 41 | 1 | $—CH_3$ | 2-$N(C_2H_5)_2$ |
| 42 | 1 | $—CH_3$ | 3-$N(C_2H_5)_2$ |
| 43 | 1 | $—CH_3$ | 4-$N(C_2H_5)_2$ |
| 44 | 1 | $—CH_3$ | 2-$N(CH_2—C_6H_5)_2$ |
| 45 | 1 | $—CH_3$ | 3-$N(CH_2—C_6H_5)_2$ |
| 46 | 1 | $—CH_3$ | 4-$N(CH_2—C_6H_5)_2$ |
| 47 | 1 | $—C_2H_5$ | —H |
| 48 | 1 | $—C_2H_5$ | 2-$CH_3$ |
| 49 | 1 | $—C_2H_5$ | 3-$CH_3$ |
| 50 | 1 | $—C_2H_5$ | 4-$CH_3$ |
| 51 | 1 | $—C_2H_5$ | 2-$C_2H_5$ |
| 52 | 1 | $—C_2H_5$ | 3-$C_2H_5$ |
| 53 | 1 | $—C_2H_5$ | 4-$C_2H_5$ |
| 54 | 1 | $—C_2H_5$ | 2-$(CH_2)_2CH_3$ |
| 55 | 1 | $—C_2H_5$ | 3-$(CH_2)_2CH_3$ |
| 56 | 1 | $—C_2H_5$ | 4-$(CH_2)_2CH_3$ |
| 57 | 1 | $—C_2H_5$ | 4-$CH(CH_3)_2$ |
| 58 | 1 | $—C_2H_5$ | 2-$(CH_2)_3CH_3$ |
| 59 | 1 | $—C_2H_5$ | 3-$(CH_2)_3CH_3$ |
| 60 | 1 | $—C_2H_5$ | 4-$(CH_2)_3CH_3$ |
| 61 | 1 | $—C_2H_5$ | 4-$CH_2CH(CH_3)_2$ |
| 62 | 1 | $—C_2H_5$ | 4-$CH(CH_3)CH_2CH_3$ |
| 63 | 1 | $—C_2H_5$ | 4-$C(CH_3)_3$ |
| 64 | 1 | $—C_2H_5$ | 2-$OCH_3$ |
| 65 | 1 | $—C_2H_5$ | 3-$OCH_3$ |
| 66 | 1 | $—C_2H_5$ | 4-$OCH_3$ |
| 67 | 1 | $—C_2H_5$ | 2-$OC_2H_5$ |
| 68 | 1 | $—C_2H_5$ | 3-$OC_2H_5$ |
| 69 | 1 | $—C_2H_5$ | 4-$OC_2H_5$ |
| 70 | 1 | $—C_2H_5$ | 4-$O(CH_2)_2CH_3$ |
| 71 | 1 | $—C_2H_5$ | 4-$O(CH_2)_3CH_3$ |
| 72 | 1 | $—C_2H_5$ | 2-Cl |
| 73 | 1 | $—C_2H_5$ | 3-Cl |
| 74 | 1 | $—C_2H_5$ | 4-Cl |
| 75 | 1 | $—C_2H_5$ | 2-Br |
| 76 | 1 | $—C_2H_5$ | 3-Br |
| 77 | 1 | $—C_2H_5$ | 4-Br |
| 78 | 1 | $—C_2H_5$ | 2-$NO_2$ |
| 79 | 1 | $—C_2H_5$ | 3-$NO_2$ |
| 80 | 1 | $—C_2H_5$ | 4-$NO_2$ |
| 81 | 1 | $—C_2H_5$ | 2-$NH_2$ |
| 82 | 1 | $—C_2H_5$ | 3-$NH_2$ |
| 83 | 1 | $—C_2H_5$ | 4-$NH_2$ |
| 84 | 1 | $—C_2H_5$ | 2-$N(CH_3)_2$ |
| 85 | 1 | $—C_2H_5$ | 3-$N(CH_3)_2$ |
| 86 | 1 | $—C_2H_5$ | 4-$N(CH_3)_2$ |

-continued

| Compound No. | n | R | X |
|---|---|---|---|
| 87 | 1 | $-C_2H_5$ | $2\text{-}N(C_2H_5)_2$ |
| 88 | 1 | $-C_2H_5$ | $3\text{-}N(C_2H_5)_2$ |
| 89 | 1 | $-C_2H_5$ | $4\text{-}N(C_2H_5)_2$ |
| 90 | 1 | $-C_2H_5$ | $2\text{-}N(CH_2-\bigcirc)_2$ |
| 91 | 1 | $-C_2H_5$ | $3\text{-}N(CH_2-\bigcirc)_2$ |
| 92 | 1 | $-C_2H_5$ | $4\text{-}N(CH_2-\bigcirc)_2$ |
| 93 | 1 | $-(CH_2)_2CH_3$ | $-H$ |
| 94 | 1 | $-(CH_2)_2CH_3$ | $4\text{-}CH_3$ |
| 95 | 1 | $-(CH_2)_2CH_3$ | $4\text{-}C_2H_5$ |
| 96 | 1 | $-(CH_2)_2CH_3$ | $4\text{-}(CH_2)_2CH_3$ |
| 97 | 1 | $-(CH_2)_2CH_3$ | $4\text{-}CH(CH_3)_2$ |
| 98 | 1 | $-(CH_2)_2CH_3$ | $4\text{-}(CH_2)_3CH_3$ |
| 99 | 1 | $-(CH_2)_2CH_3$ | $4\text{-}CH_2CH(CH_3)_2$ |
| 100 | 1 | $-(CH_2)_2CH_3$ | $4\text{-}CH(CH_3)CH_2CH_3$ |
| 101 | 1 | $-(CH_2)_2CH_3$ | $4\text{-}C(CH_3)_3$ |
| 102 | 1 | $-(CH_2)_2CH_3$ | $4\text{-}OCH_3$ |
| 103 | 1 | $-(CH_2)_2CH_3$ | $4\text{-}OC_2H_5$ |
| 104 | 1 | $-(CH_2)_2CH_3$ | $4\text{-}O(CH_2)_2CH_3$ |
| 105 | 1 | $-(CH_2)_2CH_3$ | $4\text{-}O(CH_2)_3CH_3$ |
| 106 | 1 | $-(CH_2)_2CH_3$ | 4-Cl |
| 107 | 1 | $-(CH_2)_2CH_3$ | 4-Br |
| 108 | 1 | $-(CH_2)_2CH_3$ | $4\text{-}NO_2$ |
| 109 | 1 | $-(CH_2)_2CH_3$ | $4\text{-}NH_2$ |
| 110 | 1 | $-(CH_2)_2CH_3$ | $4\text{-}N(CH_3)_2$ |
| 111 | 1 | $-(CH_2)_2CH_3$ | $4\text{-}N(C_2H_5)_2$ |
| 112 | 1 | $-(CH_2)_2CH_3$ | $4\text{-}N(CH_2-\bigcirc)_2$ |
| 113 | 1 | $-CH(CH_3)_2$ | $-H$ |
| 114 | 1 | $-CH(CH_3)_2$ | $4\text{-}CH_3$ |
| 115 | 1 | $-CH(CH_3)_2$ | $4\text{-}C_2H_5$ |
| 116 | 1 | $-CH(CH_3)_2$ | $4\text{-}(CH_2)_2CH_3$ |
| 117 | 1 | $-CH(CH_3)_2$ | $4\text{-}CH(CH_3)_2$ |
| 118 | 1 | $-CH(CH_3)_2$ | $4\text{-}(CH_2)_3CH_3$ |
| 119 | 1 | $-CH(CH_3)_2$ | $4\text{-}CH_2CH(CH_3)_2$ |
| 120 | 1 | $-CH(CH_3)_2$ | $4\text{-}CH(CH_3)CH_2CH_3$ |
| 121 | 1 | $-CH(CH_3)_2$ | $4\text{-}C(CH_3)_3$ |
| 122 | 1 | $-CH(CH_3)_2$ | $4\text{-}OCH_3$ |
| 123 | 1 | $-CH(CH_3)_2$ | $4\text{-}OC_2H_5$ |
| 124 | 1 | $-CH(CH_3)_2$ | $4\text{-}O(CH_2)_2CH_3$ |
| 125 | 1 | $-CH(CH_3)_2$ | $4\text{-}O(CH_2)_3CH_3$ |
| 126 | 1 | $-CH(CH_3)_2$ | 4-Cl |
| 127 | 1 | $-CH(CH_3)_2$ | 4-Br |
| 128 | 1 | $-CH(CH_3)_2$ | $4\text{-}NO_2$ |
| 129 | 1 | $-CH(CH_3)_2$ | $4\text{-}NH_2$ |
| 130 | 1 | $-CH(CH_3)_2$ | $4\text{-}N(CH_3)_2$ |
| 131 | 1 | $-CH(CH_3)_2$ | $4\text{-}N(C_2H_5)_2$ |
| 132 | 1 | $-CH(CH_3)_2$ | $4\text{-}N(CH_2-\bigcirc)_2$ |
| 133 | 1 | $-(CH_2)_3CH_3$ | $-H$ |
| 134 | 1 | $-(CH_2)_3CH_3$ | $4\text{-}CH_3$ |
| 135 | 1 | $-(CH_2)_3CH_3$ | $4\text{-}C_2H_5$ |
| 136 | 1 | $-(CH_2)_3CH_3$ | $4\text{-}(CH_2)_2CH_3$ |
| 137 | 1 | $-(CH_2)_3CH_3$ | $4\text{-}CH(CH_3)_2$ |
| 138 | 1 | $-(CH_2)_3CH_3$ | $4\text{-}(CH_2)_3CH_3$ |
| 139 | 1 | $-(CH_2)_3CH_3$ | $4\text{-}CH_2CH(CH_3)_2$ |
| 140 | 1 | $-(CH_2)_3CH_3$ | $4\text{-}CH(CH_3)CH_2CH_3$ |
| 141 | 1 | $-(CH_2)_3CH_3$ | $4\text{-}C(CH_3)_3$ |
| 142 | 1 | $-(CH_2)_3CH_3$ | $4\text{-}OCH_3$ |
| 143 | 1 | $-(CH_2)_3CH_3$ | $4\text{-}OC_2H_5$ |
| 144 | 1 | $-(CH_2)_3CH_3$ | $4\text{-}O(CH_2)_2CH_3$ |
| 145 | 1 | $-(CH_2)_3CH_3$ | $4\text{-}O(CH_2)_3CH_3$ |
| 146 | 1 | $-(CH_2)_3CH_3$ | 4-Cl |
| 147 | 1 | $-(CH_2)_3CH_3$ | 4-Br |
| 148 | 1 | $-(CH_2)_3CH_3$ | $4\text{-}NO_2$ |

-continued

| Compound No. | n | R | X |
|---|---|---|---|
| 149 | 1 | $-(CH_2)_3CH_3$ | $4\text{-}NH_2$ |
| 150 | 1 | $-(CH_2)_3CH_3$ | $4\text{-}N(CH_3)_2$ |
| 151 | 1 | $-(CH_2)_3CH_3$ | $4\text{-}N(C_2H_5)_2$ |
| 152 | 1 | $-(CH_2)_3CH_3$ | $4\text{-}N(CH_2-\bigcirc)_2$ |
| 153 | 1 | $-CH_2CH(CH_3)_2$ | $-H$ |
| 154 | 1 | $-CH_2CH(CH_3)_2$ | $4\text{-}CH_3$ |
| 155 | 1 | $-CH_2CH(CH_3)_2$ | $4\text{-}C_2H_5$ |
| 156 | 1 | $-CH_2CH(CH_3)_2$ | $4\text{-}(CH_2)_2CH_3$ |
| 157 | 1 | $-CH_2CH(CH_3)_2$ | $4\text{-}CH(CH_3)_2$ |
| 158 | 1 | $-CH_2CH(CH_3)_2$ | $4\text{-}(CH_2)_3CH_3$ |
| 159 | 1 | $-CH_2CH(CH_3)_2$ | $4\text{-}CH_2CH(CH_3)_2$ |
| 160 | 1 | $-CH_2CH(CH_3)_2$ | $4\text{-}CH(CH_3)CH_2CH_3$ |
| 161 | 1 | $-CH_2CH(CH_3)_2$ | $4\text{-}C(CH_3)_3$ |
| 162 | 1 | $-CH_2CH(CH_3)_2$ | $4\text{-}OCH_3$ |
| 163 | 1 | $-CH_2CH(CH_3)_2$ | $4\text{-}OC_2H_5$ |
| 164 | 1 | $-CH_2CH(CH_3)_2$ | $4\text{-}O(CH_2)_2CH_3$ |
| 165 | 1 | $-CH_2CH(CH_3)_2$ | $4\text{-}O(CH_2)_3CH_3$ |
| 166 | 1 | $-CH_2CH(CH_3)_2$ | 4-Cl |
| 167 | 1 | $-CH_2CH(CH_3)_2$ | 4-Br |
| 168 | 1 | $-CH_2CH(CH_3)_2$ | $4\text{-}NO_2$ |
| 169 | 1 | $-CH_2CH(CH_3)_2$ | $4\text{-}NH_2$ |
| 170 | 1 | $-CH_2CH(CH_3)_2$ | $4\text{-}N(CH_3)_2$ |
| 171 | 1 | $-CH_2CH(CH_3)_2$ | $4\text{-}N(C_2H_5)_2$ |
| 172 | 1 | $-CH_2CH(CH_3)_2$ | $4\text{-}N(CH_2-\bigcirc)_2$ |
| 173 | 1 | $-CH_2-\bigcirc$ | $-H$ |
| 174 | 1 | $-CH_2-\bigcirc$ | $4\text{-}CH_3$ |
| 175 | 1 | $-CH_2-\bigcirc$ | $4\text{-}C_2H_5$ |
| 176 | 1 | $-CH_2-\bigcirc$ | $4\text{-}(CH_2)_3CH_3$ |
| 177 | 1 | $-CH_2-\bigcirc$ | $4\text{-}CH(CH_3)_2$ |
| 178 | 1 | $-CH_2-\bigcirc$ | $4\text{-}(CH_2)_3CH_3$ |
| 179 | 1 | $-CH_2-\bigcirc$ | $4\text{-}CH_2CH(CH_3)_2$ |
| 180 | 1 | $-CH_2-\bigcirc$ | $4\text{-}CH(CH_3)CH_2CH_3$ |
| 181 | 1 | $-CH_2-\bigcirc$ | $4\text{-}C(CH_3)_3$ |
| 182 | 1 | $-CH_2-\bigcirc$ | $4\text{-}OCH_3$ |
| 183 | 1 | $-CH_2-\bigcirc$ | $4\text{-}OC_2H_5$ |
| 184 | 1 | $-CH_2-\bigcirc$ | $4\text{-}O(CH_2)_2CH_3$ |

-continued

| Compound No. | n | R | X |
|---|---|---|---|
| 185 | 1 | $-CH_2-C_6H_5$ | $4\text{-}O(CH_2)_3CH_3$ |
| 186 | 1 | $-CH_2-C_6H_5$ | 4-Cl |
| 187 | 1 | $-CH_2-C_6H_5$ | 4-Br |
| 188 | 1 | $-CH_2-C_6H_5$ | $4\text{-}NO_2$ |
| 189 | 1 | $-CH_2-C_6H_5$ | $4\text{-}NH_2$ |
| 190 | 1 | $-CH_2-C_6H_5$ | $4\text{-}N(CH_3)_2$ |
| 191 | 1 | $-CH_2-C_6H_5$ | $4\text{-}N(C_2H_5)_2$ |
| 192 | 1 | $-CH_2-C_6H_5$ | $4\text{-}N(CH_2-C_6H_5)_2$ |
| 193 | 2 | $-CH_3$ | —H |
| 194 | 2 | $-CH_3$ | $4\text{-}CH_3$ |
| 195 | 2 | $-CH_3$ | $4\text{-}C_2H_5$ |
| 196 | 2 | $-CH_3$ | $4\text{-}OCH_3$ |
| 197 | 2 | $-CH_3$ | $4\text{-}OC_2H_5$ |
| 198 | 2 | $-CH_3$ | 4-Cl |
| 199 | 2 | $-CH_3$ | 4-Br |
| 200 | 2 | $-CH_3$ | $4\text{-}NO_2$ |
| 201 | 2 | $-CH_3$ | $4\text{-}NH_2$ |
| 202 | 2 | $-CH_3$ | $4\text{-}N(CH_3)_2$ |
| 203 | 2 | $-CH_3$ | $4\text{-}N(C_2H_5)_2$ |
| 204 | 2 | $-CH_3$ | $4\text{-}N(CH_2-C_6H_5)_2$ |
| 205 | 2 | $-C_2H_5$ | —H |
| 206 | 2 | $-C_2H_5$ | $4\text{-}CH_3$ |
| 207 | 2 | $-C_2H_5$ | $4\text{-}C_2H_5$ |
| 208 | 2 | $-C_2H_5$ | $4\text{-}OCH_3$ |
| 209 | 2 | $-C_2H_5$ | $4\text{-}OC_2H_5$ |
| 210 | 2 | $-C_2H_5$ | 4-Cl |
| 211 | 2 | $-C_2H_5$ | 4-Br |
| 212 | 2 | $-C_2H_5$ | $4\text{-}NO_2$ |
| 213 | 2 | $-C_2H_5$ | $4\text{-}NH_2$ |
| 214 | 2 | $-C_2H_5$ | $4\text{-}N(CH_3)_2$ |
| 215 | 2 | $-C_2H_5$ | $4\text{-}N(C_2H_5)_2$ |
| 216 | 2 | $-C_2H_5$ | $4\text{-}N(CH_2-C_6H_5)_2$ |
| 217 | 2 | $-(CH_2)_2CH_3$ | —H |
| 218 | 2 | $-(CH_2)_2CH_3$ | $4\text{-}CH_3$ |
| 219 | 2 | $-(CH_2)_2CH_3$ | $4\text{-}C_2H_5$ |
| 220 | 2 | $-(CH_2)_2CH_3$ | $4\text{-}OCH_3$ |
| 221 | 2 | $-(CH_2)_2CH_3$ | $4\text{-}OC_2H_5$ |
| 222 | 2 | $-(CH_2)_2CH_3$ | 4-Cl |
| 223 | 2 | $-(CH_2)_2CH_3$ | 4-Br |
| 224 | 2 | $-(CH_2)_2CH_3$ | $4\text{-}NO_2$ |
| 225 | 2 | $-(CH_2)_2CH_3$ | $4\text{-}NH_2$ |
| 226 | 2 | $-(CH_2)_2CH_3$ | $4\text{-}N(CH_3)_2$ |
| 227 | 2 | $-(CH_2)_2CH_3$ | $4\text{-}N(C_2H_5)_2$ |
| 228 | 2 | $-(CH_2)_2CH_3$ | $4\text{-}N(CH_2-C_6H_5)_2$ |

-continued

| Compound No. | n | R | X |
|---|---|---|---|
| 229 | 2 | $-CH(CH_3)_2$ | —H |
| 230 | 2 | $-CH(CH_3)_2$ | $4\text{-}CH_3$ |
| 231 | 2 | $-CH(CH_3)_2$ | $4\text{-}C_2H_5$ |
| 232 | 2 | $-CH(CH_3)_2$ | $4\text{-}OCH_3$ |
| 233 | 2 | $-CH(CH_3)_2$ | $4\text{-}OC_2H_5$ |
| 234 | 2 | $-CH(CH_3)_2$ | 4-Cl |
| 235 | 2 | $-CH(CH_3)_2$ | 4-Br |
| 236 | 2 | $-CH(CH_3)_2$ | $4\text{-}NO_2$ |
| 237 | 2 | $-CH(CH_3)_2$ | $4\text{-}NH_2$ |
| 238 | 2 | $-CH(CH_3)_2$ | $4\text{-}N(CH_3)_2$ |
| 239 | 2 | $-CH(CH_3)_2$ | $4\text{-}N(C_2H_5)_2$ |
| 240 | 2 | $-CH(CH_3)_2$ | $4\text{-}N(CH_2-C_6H_5)_2$ |
| 241 | 2 | $-(CH_2)_3CH_3$ | —H |
| 242 | 2 | $-(CH_2)_3CH_3$ | $4\text{-}CH_3$ |
| 243 | 2 | $-(CH_2)_3CH_3$ | $4\text{-}C_2H_5$ |
| 244 | 2 | $-(CH_2)_3CH_3$ | $4\text{-}OCH_3$ |
| 245 | 2 | $-(CH_2)_3CH_3$ | $4\text{-}OC_2H_5$ |
| 246 | 2 | $-(CH_2)_3CH_3$ | 4-Cl |
| 247 | 2 | $-(CH_2)_3CH_3$ | 4-Br |
| 248 | 2 | $-(CH_2)_3CH_3$ | $4\text{-}NO_2$ |
| 249 | 2 | $-(CH_2)_3CH_3$ | $4\text{-}NH_2$ |
| 250 | 2 | $-(CH_2)_3CH_3$ | $4\text{-}N(CH_3)_2$ |
| 251 | 2 | $-(CH_2)_3CH_3$ | $4\text{-}N(C_2H_5)_2$ |
| 252 | 2 | $-(CH_2)_3CH_3$ | $4\text{-}N(CH_2-C_6H_5)_2$ |
| 253 | 2 | $-CH_2CH(CH_3)_2$ | —H |
| 254 | 2 | $-CH_2CH(CH_3)_2$ | $4\text{-}CH_3$ |
| 255 | 2 | $-CH_2CH(CH_3)_2$ | $4\text{-}C_2H_5$ |
| 256 | 2 | $-CH_2CH(CH_3)_2$ | $4\text{-}OCH_3$ |
| 257 | 2 | $-CH_2CH(CH_3)_2$ | $4\text{-}OC_2H_5$ |
| 258 | 2 | $-CH_2CH(CH_3)_2$ | 4-Cl |
| 259 | 2 | $-CH_2CH(CH_3)_2$ | 4-Br |
| 260 | 2 | $-CH_2CH(CH_3)_2$ | $4\text{-}NO_2$ |
| 261 | 2 | $-CH_2CH(CH_3)_2$ | $4\text{-}NH_2$ |
| 262 | 2 | $-CH_2CH(CH_3)_2$ | $4\text{-}N(CH_3)_2$ |
| 263 | 2 | $-CH_2CH(CH_3)_2$ | $4\text{-}N(C_2H_5)_2$ |
| 264 | 2 | $-CH_2CH(CH_3)_2$ | $4\text{-}N(CH_2-C_6H_5)_2$ |
| 265 | 2 | $-CH_2-C_6H_5$ | —H |
| 266 | 2 | $-CH_2-C_6H_5$ | $4\text{-}CH_3$ |
| 267 | 2 | $-CH_2-C_6H_5$ | $4\text{-}C_2H_5$ |
| 268 | 2 | $-CH_2-C_6H_5$ | $4\text{-}OCH_3$ |
| 269 | 2 | $-CH_2-C_6H_5$ | $4\text{-}OC_2H_5$ |
| 270 | 2 | $-CH_2-C_6H_5$ | 4-Cl |
| 271 | 2 | $-CH_2-C_6H_5$ | 4-Br |
| 272 | 2 | $-CH_2-C_6H_5$ | $4\text{-}NO_2$ |

-continued

| Compound No. | n | R | X |
|---|---|---|---|
| 273 | 2 | $-CH_2-$ 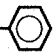 | 4-$NH_2$ |
| 274 | 2 | $-CH_2-$ 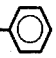 | 4-$N(CH_3)_2$ |
| 275 | 2 | $-CH_2-$ 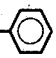 | 4-$N(C_2H_5)_2$ |
| 276 | 2 | $-CH_2-$ 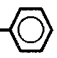 | 4-$N(CH_2-$ 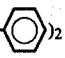 $)_2$ |

The electrophotographic elements according to the present invention comprise incorporating one or two or more of the above enumerated carbazole derivative compounds in the photosensitive layer 2 (2' or 2''). These carbazole derivative compounds can be used as shown in FIG. 1, FIG. 2 or FIG. 3 depending upon the way of applying.

The element illustrated in FIG. 1 comprises an electrically conductive substrate 1 and a photosensitive layer 2, superposed on said substrate, consisting of a carbazole derivative compound, a sensitizing dye and a binding agent (a binder resin). In this element, the carbazole derivative compound functions as a photoconductive material so that the generation and transfer of charges required for light decay are effected through the carbazole derivative compound. However, since the carbazole derivative compound is scarcely absorptive to visible light region, when utilized for the purpose of forming an image by means of visible light, there is necessity of adding a sensitizing dye being absorptive to visible light region and sensitizing the carbazole derivative compound.

Figure 2:
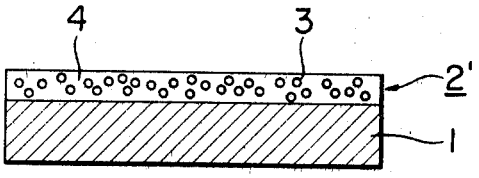

The element illustrated in FIG. 2 comprises an electrically conductive substrate 1 and a photosensitive layer 2', superposed on said substrate, formed by dispersing a charge carrier generating material 3 in a charge transfer medium 4 consisting of a carbazole derivative compound and a binding agent. In this element, the carbazole derivative compound forms a charge transfer medium in conjunction with a binding agent (or a binding agent and a plasticizer), while the charge carrier generating material 3 (such as an inorganic or organic pigment) generates charge carriers. In this case, the main part of the charge transfer medium 4 is to accept charges the charge carrier generating material 3 generates and to transfer the generated charges. In this element, it is fundamentally required that the absorption wave length regions of both the charge carrier generating material and the carbazole derivative compound should not overlap each other mainly in the visible light region. The reason is that in order to permit the charge carrier generating material 3 to generate charge carriers with efficiency, it is necessary to transmit light up to the surface of the charge carrier generating material. The carbazole derivative compound having the general formula (I) is characterized in that it is scarcely absorptive to the visible light region and generally acts as the charge transfer material effectively especially when combined with the charge carrier generating material 3 capable of generating charges upon absorption of light in the visible region.

Figure 3:
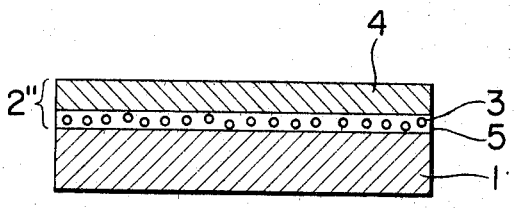

The element illustrated in FIG. 3 comprises an electrically conductive substrate 1 and a photosensitive layer 2'', superposed on said substrate, that is formed in a layer by placing a charge transfer layer 4 containing the carbazole derivative compound over a charge carrier generating layer 5 composed mainly of a charge carrier generating material 3. In this element, the light transmitted through the charge transfer layer 4 reaches the charge carrier generating layer 5 to thereby generate charges at the light-struck portions, while the thus generated charges are injected in the charge transfer layer 4 and transferred thereby. The mechanism employed herein that the generation of charges required for light decay is allotted to the charge carrier generating material 3 and the transfer of the generated charges is allotted to the charge transfer layer 4 (wherein the carbazole derivative compound mainly acts for that purpose) is the same as explained with reference to the element illustrated in FIG. 2.

The actual preparation of the elements according to the present invention will be explained hereinafter. The element illustrated in FIG. 1 may be prepared by obtaining a solution by dissolving one or two or more of carbazole derivative compounds in a binder solution and further added with a sensitizing dye, coating the thus obtained solution onto an electrically conductive substrate 1 and drying for forming a photosensitive layer 2.

The thickness of said photosensitive layer 2 is suitably in the range of 3–50 μm, preferably in the range of 5–20 μm. The amount of the carbazole derivative compound occupying the photosensitive layer 2 is in the range of 30–70 wt.%, preferably about 50 wt.%, and the amount of the sensitizing dye occupying the photosensitive layer 2 is in the range of 0.1–5 wt.%, preferably in the range of 0.5–3 wt.%. As the sensitizing dyes suitably used in the element of FIG. 1 there can be enumerated triarylmethane dyes such as Brilliant Green, Victoria Blue B, Methyl Violet, Crystal Violet, Acid Violet 6B and the like; xanthene dyes such as Rhodamine B, Rhodamine 6G, Rhodamine G Extra, Eosine S, Erythrosine, Rose Bengale, fluorescene and the like; thiazine dyes such as Methylene Blue and the like; cyanine dyes such as cyanine and the like; pyrylium dyes such as 2,6-diphenyl-4-(N,N-dimethylaminophenyl)-thiapyrylium perchlorate, benzo pyrylium salt disclosed in Japanese Patent Publication No. 25658/1973 and the like, and so forth. These sensitizing dyes may be used singly or in combinations of two or more.

And, the element illustrated in FIG. 2 may be prepared by coating a solution onto an electrically conductive substrate 1, said dispersion being obtained by dispersing fine particles of a charge carrier generating material 3 in a solution containing dissolved therein one or two or more of carbazole derivative compounds and a binder, and drying to thereby form a photosensitive layer 2'.

The suitable thickness of the photosensitive layer 2' is in the range of 3–50 μm, preferably 5–20 μm. The amount of the carbazole derivative compound occupying the photosensitive layer 2' is in the range of 10–95 wt.%, preferably 30–90 wt.%, and the amount of the charge carrier generating material 3 occupying the photosensitive material 2' is in the range of 0.1–50 wt.%, preferably 1–20 wt.%. The charge carrier generating materials 3 include azo pigments comprised of inorganic pigments such as selenium, selenium-tellurium, cadmium sulfide, cadmium sulfide-selenium, etc. and organic pigments such as CI Pigment Blue 25 (CI 21180), CI Pigment Red 41 (CI 21200), CI Acid Red 52 (CI 45100), CI Basic Red 3 (CI 45210), the azo pigment having a carbazole skeleton (Japanese Laid Open Patent Application No. 95033/1978), the azo pigment having a distyryl benzene skeleton (Japanese Laid Open Patent Application No. 133445/1978), the azo pigment having a triphenylamine skeleton (Japanese Laid Open Patent Application No. 132347/1978), the azo pigment having a dibenzothiophene skeleton (Japanese Laid Open Patent Application No. 21728/1979), the azo pigment having an oxadiazole skeleton (Japanese Laid Open Patent Application No. 12742/1979), the azo pigment having a fluorenone skeleton (Japanese Laid Open Patent Application No. 22834/1979), the azo pigment having a bisstilbene skeleton (Japanese Laid Open Patent Application No. 17733/1979), the azo pigment having a distyryloxadiazole skeleton (Japanese Laid Open Patent Application No. 2129/1979), the azo pigment having a distyrylcarbazole skeleton (Japanese Laid Open Patent Application No. 14967/1979), etc.; phthalocyanine type pigments such as CI Pigment Blue 16 (CI 74100), etc.; indigo type pigments such as CI Bat Brown 5 (CI 73410), CI Bat Dye (CI 73030), etc.; perpylene type pigments such as Argoscarlet B (available from Bayer Company), Indanthrene Scarlet R (available from Bayer Company) and so forth. In this connection, it is to be noted that these charge carrier generating materials may be used singly or in combinations of two or more.

Further, the element illustrated in FIG. 3 may be prepared by vacuum-vapordepositing a charge carrier generating material on an electrically conductive substrate 1 or coating it with a dispersion obtained by dispersing fine particles 3 of the charge carrier generating material in a suitable solvent containing a binding agent dissolved therein, if needed, and drying, or subjecting the same to surface finishing or film thickness regulation by buffing or the like, if further needed, thereby forming a charge carrier generating layer 5, and then applying thereon a solution having dissolved therein one or two or more of carbazole derivative compounds and a binding agent and drying, thereby forming a charge transfer layer 4. In this connection, it is to be noted that the charge carrier generating materials used for the formation of the charge carrier generating layer 5 are the same with those enumerated in the explanation of the aforesaid photosensitive layer 2'.

The suitable thickness of the charge carrier generating layer 5 is 5 μm or less, preferably 2 μm or less, while the suitable thickness of the charge transfer layer 4 is in the range of 3–50 μm, preferably 5–20 μm. In case the charge carrier generating layer 5 is of such a type that fine particles 3 of the charge carrier generating material have been dispersed in a binding agent, the percentage of fine particles 3 of the charge carrier generating material occupying the charge carrier generating layer 5 is about 10–95 wt.%, preferably about 50–90 wt.%. And, the amount of the carbazole derivative compound occupying the charge transfer layer 4 is in the range of 10–95 wt.%, preferably 30–90 wt.%.

In the preparation of any one of the above enumerated elements, as the electrically conductive substrate 1 there may be employed a metallic plate or foil of aluminum or the like, an aluminum or the like evaporation deposited plastic film, a conductively treated paper or the like. As the binding agent there may employed condensation resins such as polyamide, polyurethane, polyester, epoxy resin, polyketone, polycarbonate, etc., vinyl polymers such as polyvinyl ketone, polystyrene, poly-N-vinylcarbazole, polyacrylamide, etc., and the like. In this connection, however, it is to be noted that any insulating as well as adhesive resin may be employed for that purpose. As mentioned above, if needed, a plasticizer may be added to the binding agent. As these plasticizers there may be enumerated paraffin halide, polybiphenyl chloride, dimethylnaphthalene, dibutyl phthalate and so forth.

Further, it is to be noted that every element obtained as mentioned above may be provided with an adhesive layer or a barrier layer, if needed, between the electrically conductive substrate and the photosensitive layer. The materials used in said adhesive or barrier layer include polyamide, nitrocellulose, aluminum oxide, etc., and the preferable film thickness of said layer is 1 μm or less.

In carrying out the copying operation using the element according to the present invention, the surface of the element is first electrified and exposed to light, then the element is developed, and the thus formed image is transferred onto paper or the like. The element according to the present invention is advantageous in that it has a high sensitivity, is rich in flexibility and the like.

EXAMPLES

The parts given are all by weight.

EXAMPLE 1

76 parts of Dian Blue (CI Pigment Blue 25, CI 21180) as a charge carrier generating material, 1260 parts of a 2% tetrahydrofuran solution of polyester resin (VYLON 200 available from Toyo Boseki K.K.) and 3700 parts of tetrahydrofuran were pulverized and mixed in a ball mill to thereby obtain a dispersion. This is dispersion was applied onto an aluminum surface of an electrically conductive substrate comprising an aluminum vapor-deposited polyester base by means of a doctor blade and air-dried thereby to form an about 1 μm-thick charge carrier generating layer.

On the other hand, 2 parts of No. 47 carbazole derivative compound as a charge transfer material, 2 parts of polycarbonate resin (Panlite K 1300 available from TEIJIN) and 16 parts of tetrahydrofuran were pulverized and mixed in a ball mill thereby to obtain a solution. This solution was applied onto said charge carrier generating layer by means of a doctor blade and dried at 80° C. for 2 minutes and then at 105° C. for 5 minutes thereby to form an about 20 μm-thick charge transfer layer. Thus, Element No. 1 was prepared.

EXAMPLES 2 to 27

Elements Nos. 2 to 27 were prepared by repeating the exactly same procedure as Example 1 except that the charge carrier generating material and the charge transfer material (carbazole derivative compound) were replaced by those enumerated in Table-1.

TABLE-1
| Element No. | Charge carrier generating material | Charge transfer material (carbazole derivative compound No.) |
|---|---|---|
| 1* | 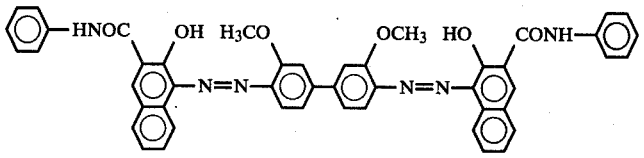 | 47 |
| 2 | 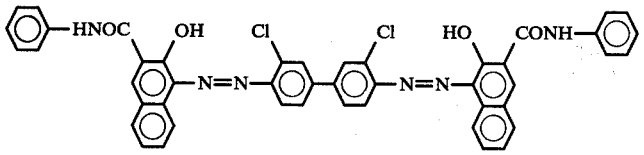 | 47 |
| 3 | 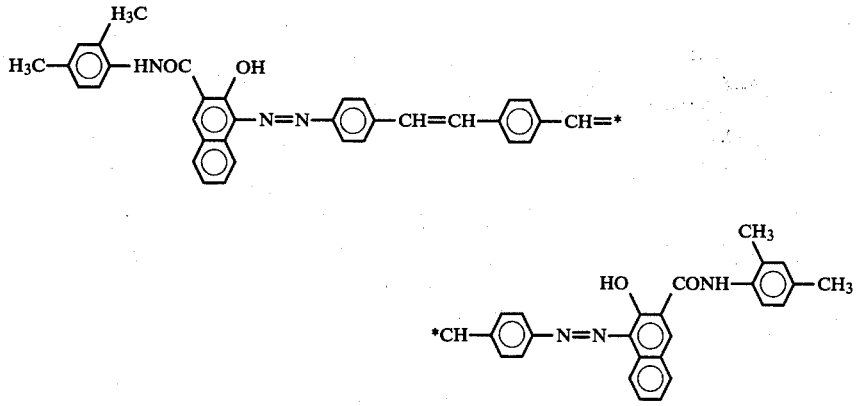 | 47 |
| 4 | 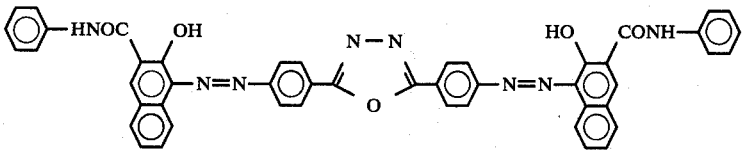 | 47 |
| 5 | 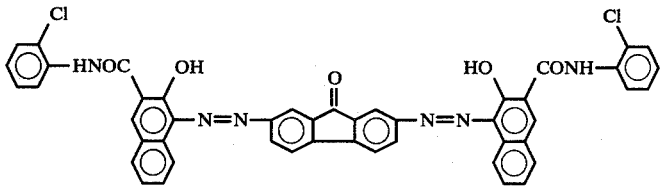 | 47 |
| 6 | 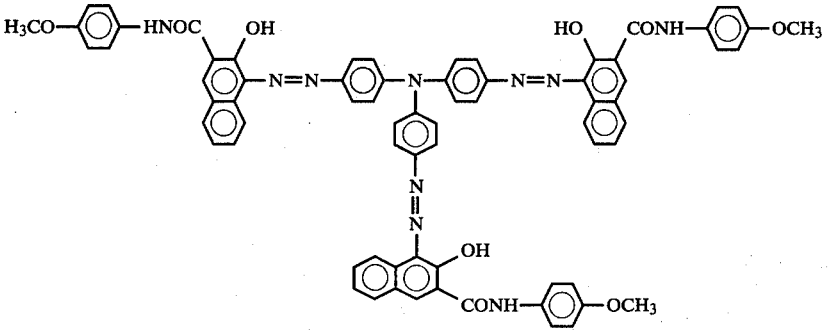 | 47 |
| 7 | β type copper phthalocyanine | 47 |

TABLE-1-continued
| Element No. | Charge carrier generating material | Charge transfer material (carbazole derivative compound No.) |
|---|---|---|
| 8 | 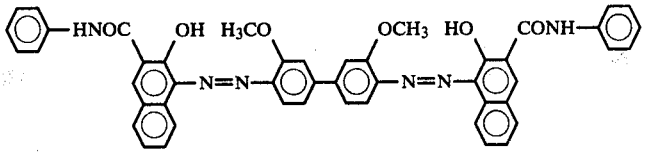 | 69 |
| 9 | 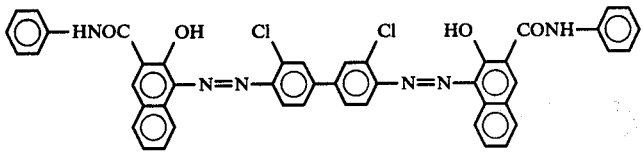 | 69 |
| 10 | 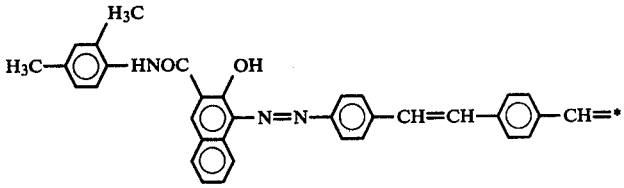 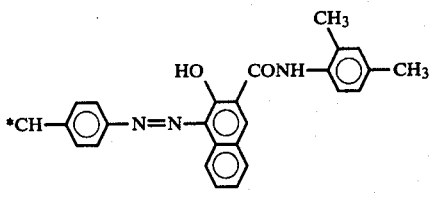 | 69 |
| 11 | 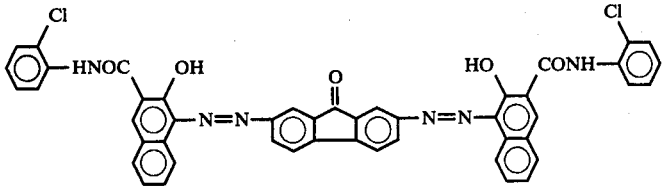 | 69 |
| 12 | 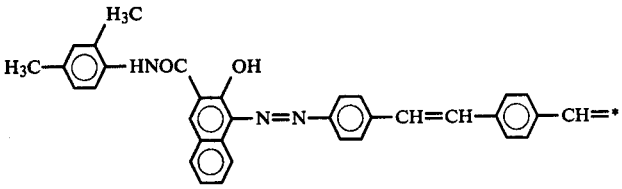 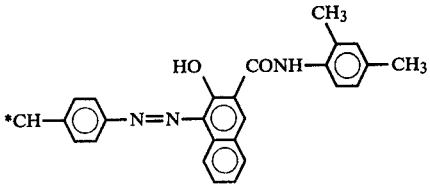 | 48 |
| 13 | 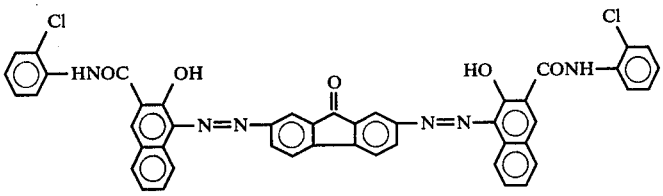 | 48 |

TABLE-1-continued
| Element No. | Charge carrier generating material | Charge transfer material (carbazole derivative compound No.) |
|---|---|---|
| 14 | 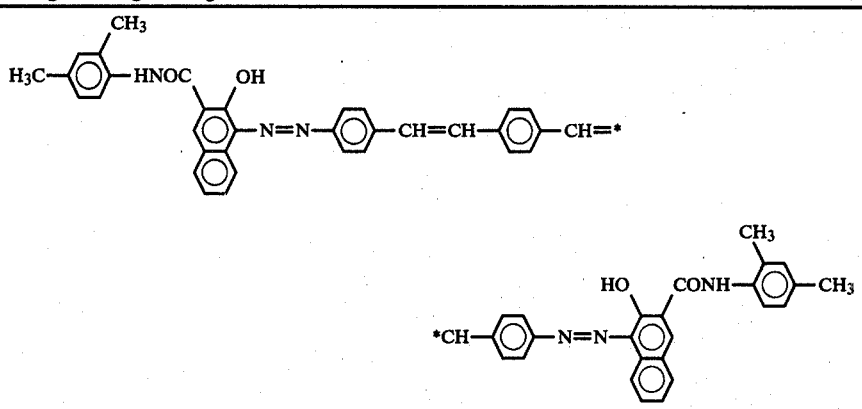 | 49 |
| 15 | 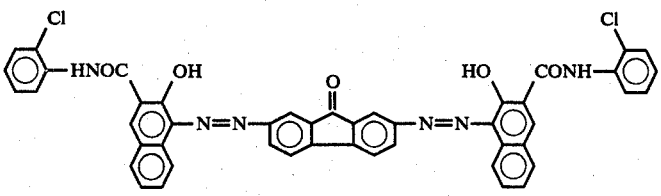 | 49 |
| 16 | 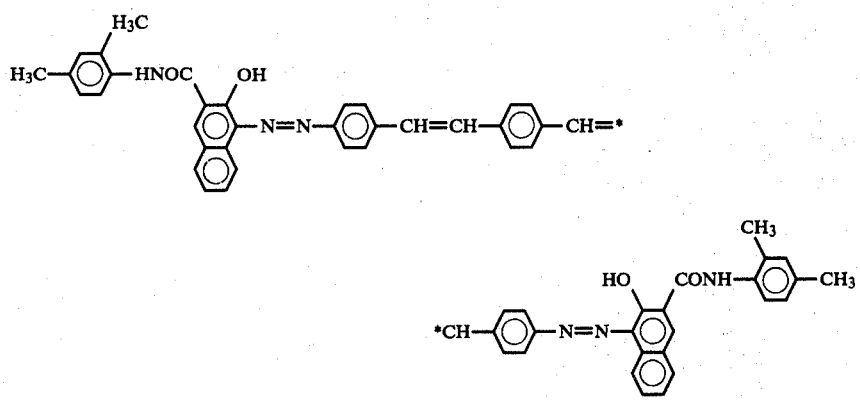 | 72 |
| 17 | 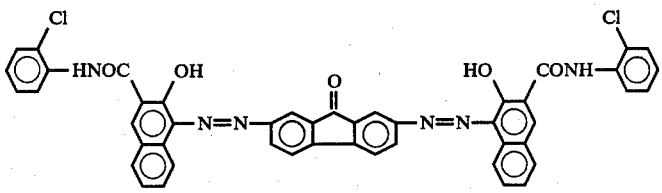 | 72 |
| 18 | 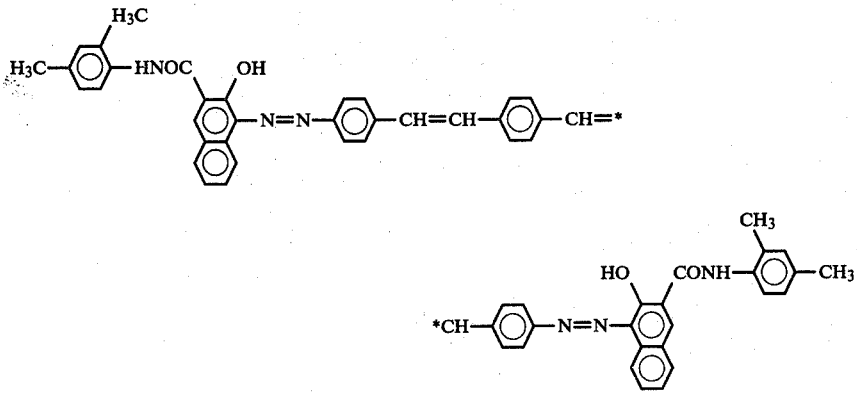 | 83 |

TABLE-1-continued
| Element No. | Charge carrier generating material | Charge transfer material (carbazole derivative compound No.) |
|---|---|---|
| 19 | 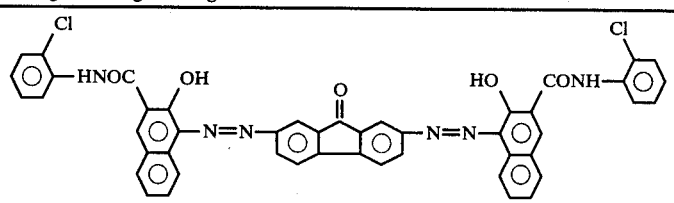 | 83 |
| 20 | 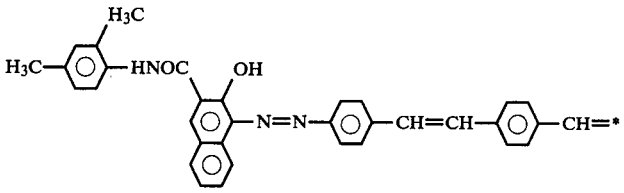 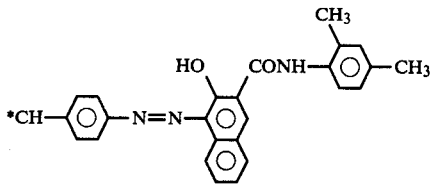 | 89 |
| 21 | 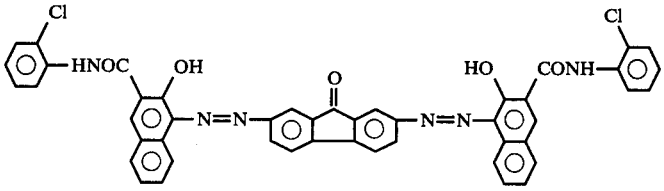 | 89 |
| 22 | 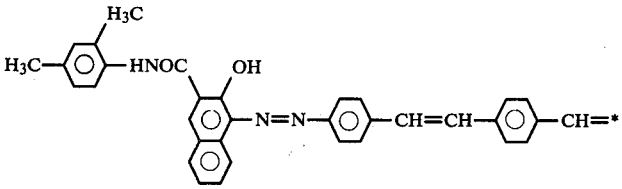 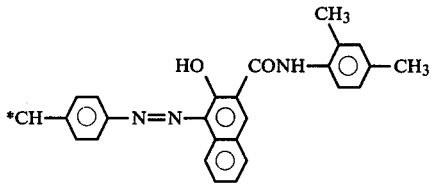 | 205 |
| 23 | 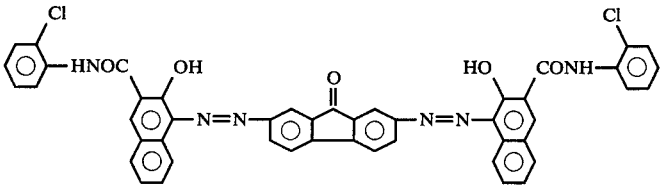 | 205 |
| 24 | 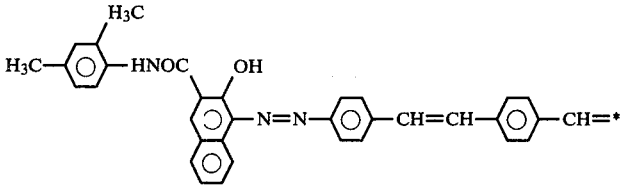 | 133 |

TABLE-1-continued

| Element No. | Charge carrier generating material | Charge transfer material (carbazole derivative compound No.) |
|---|---|---|
| | 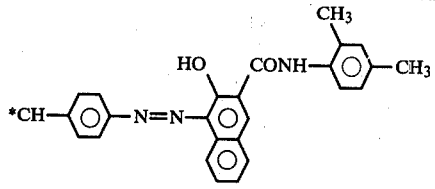 | |
| 25 | 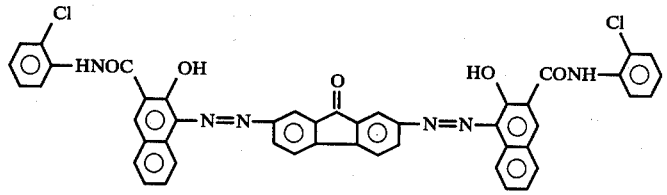 | 133 |
| 26 | 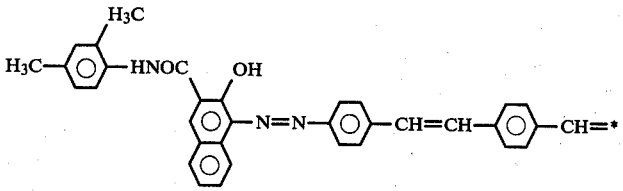 | 173 |
| | 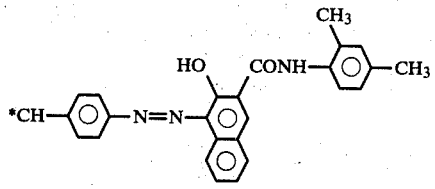 | |
| 27 | 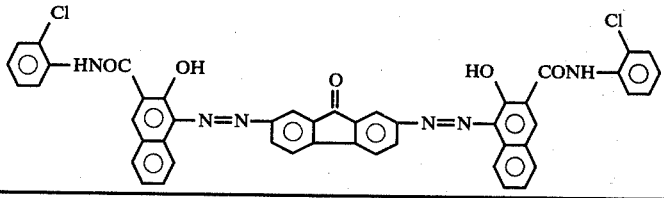 | 173 |

*1 Element No. 1 is the same with that of Example 1.

EXAMPLE 28

A charge carrier generating layer was formed by vacuum vapordepositing selenium on an about 300 μm-thick aluminum plate so as to attain a thickness of about 1 μm. Then, a charge transfer layer-forming solution was prepared by mixing 2 parts of No. 47 carbazole derivative compound, 3 parts of polyester resin (Polyester Adhesive 49000 available from du Pont) and 45 parts of tetrahydrofuran and dissolving. This solution was applied onto said charge carrier generating layer (selenium evaporation deposited layer) by means of a doctor blade, air-dried and thereafter dried at a reduced pressure to form an about 10 μm-thick charge transfer layer. Thus, Element No. 28 of the present invention was prepared.

EXAMPLE 29

Element No. 29 was prepared by repeating the exactly same procedure as Example 28 except that the charge carrier generating layer (wherein, its thickness is about 0.3 μm) was formed by employing a perillene type pigment having the following formula:

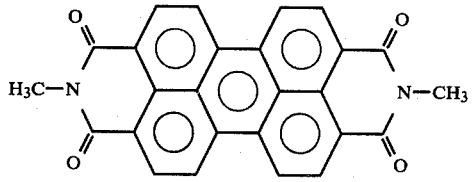

in place of the selenium used therein and No. 69 carbazole derivative compound was employed in place of No. 49 compound used therein.

EXAMPLE 30

A mixture of 1 part of Dian Blue (the same as employed in Example 1) and 158 parts of tetrahydrofuran were pulverized and mixed in a ball mill. Subsequently, the thus treated mixture was added with 12 parts of No. 47 carbazole derivative compound and 18 parts of polyester resin (Polyester Adhesive 49000 available from du Pont) and further mixed to thereby obtain a photosensitive layer-forming solution. This solution was applied onto an aluminum vapordeposited polyester film by means of a doctor blade and dried at 100° C. for 30 minutes to thereby form an about 16 μm-thick photosensitive layer. Thus, Element No. 30 of the present invention was prepared.

Thus prepared Elements Nos. 1 to 30 were subjected to −6KV or +6KV corona discharge for 20 seconds by means of a commercially available electrostatic copying paper tester (SP 428 type produced by KAWAGUSHI DENKI SEISAKUSHO K.K.) and charged accordingly. Thereafter, the same was left standing in the dark for 20 seconds for measuring the surface potential Vpo(V) at that time, and then was exposed to light from a tungsten lamp so as to attain an element surface intensity of 20 lux. Thus, the time (second) required until the surface potential was reduced to half of the Vpo was calculated to determine the exposure amount $E_{\frac{1}{2}}$ (lux.sec). The obtained results are shown in Table-2.

Further, the above mentioned elements were charged by means of a commercially available electrophotographic copying machine. Each of thus charged elements was then exposed to light through an original to thereby attain an electrostatic latent image thereon. This electrostatic latent image was developed with a dry developer. The thus obtained image (toner image) was electrostatically transferred onto an ordinary paper and fixed to thus obtain a clear-cut transferred image. In case a wet developer was employed as a developer there was likewise obtained a clear-cut transferred image.

TABLE 2

| Element No. | Vpo (Volt) | $E_{\frac{1}{2}}$ (lux · sec.) |
|---|---|---|
| 1 | −1005 | 2.8 |
| 2 | −983 | 4.1 |
| 3 | −1030 | 1.5 |
| 4 | −1200 | 7.5 |
| 5 | −1006 | 1.0 |
| 6 | −895 | 6.0 |
| 7 | −973 | 3.1 |
| 8 | −738 | 2.1 |
| 9 | −815 | 3.3 |
| 10 | −350 | 2.0 |
| 11 | −695 | 0.9 |
| 12 | −323 | 1.6 |
| 13 | −739 | 1.1 |
| 14 | −1420 | 1.5 |
| 15 | −1003 | 1.0 |
| 16 | −1409 | 1.5 |
| 17 | −1157 | 1.2 |
| 18 | −1189 | 1.4 |
| 19 | −371 | 1.6 |
| 20 | −509 | 0.9 |
| 21 | −393 | 1.2 |
| 22 | −847 | 1.5 |
| 23 | −944 | 0.9 |
| 24 | −1250 | 1.4 |
| 25 | −1081 | 1.2 |
| 26 | −958 | 1.6 |
| 27 | −598 | 5.7 |
| 28 | −1100 | 3.5 |
| 29 | −1080 | 3.3 |
| 30 | +867 | 2.5 |

We claim:

1. An electrophotographic element comprising an electrically conductive substrate and a photosensitive layer superposed thereon, wherein said photosensitive layer is a double layer that comprises a charge carrier generating sub-layer consisting essentially of a charge carrier generating material and a charge transfer sub-layer containing a carbazole derivative compound having the following formula (I):

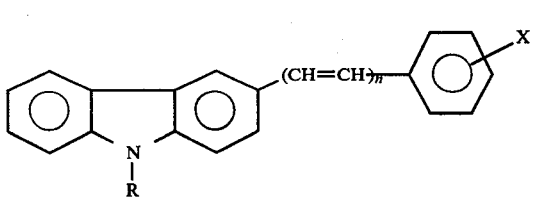

wherein R is lower alkyl; X is hydrogen, lower alkyl, lower alkoxy, amino or amino substituted with lower alkyl or benzyl; and n is 1 or 2.

2. An electrophotographic element according to claim 1 wherein the amount of said carbazole derivative compound in the charge transfer sub-layer is in the range of 10–95 wt.%.

3. An electrophotographic element comprising an electrically conductive substrate and a photosensitive layer superposed thereon, wherein said photosensitive layer is a monolayer formed by dispersing a charge carrier generating material in a charge transfer medium, said charge transfer medium consisting essentially of a mixture of a carbazole derivative compound having the following formula (I) and a binding agent

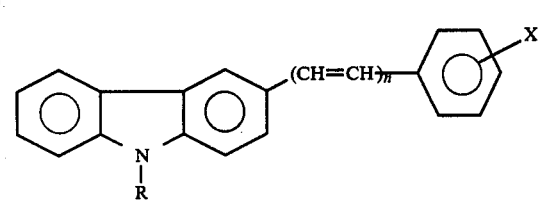

wherein R is lower alkyl; X is hydrogen, lower alkyl, lower alkoxy, amino or amino substituted with lower alkyl or benzyl; and n is 1 or 2.

4. An electrophotographic element comprising an electrically conductive substrate and a photosensitive layer superposed thereon, wherein said photosensitive layer is a monolayer formed by dispersing a charge carrier generating material in a charge transfer medium consisting essentially of a mixture of a carbazole derivative compound having the following of formula (I) and a binding agent

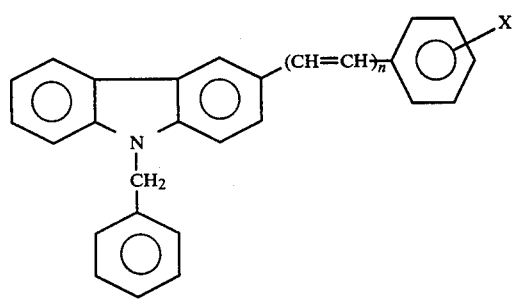

wherein X is hydrogen, lower alkyl, lower alkoxy, halogen, nitro, amino or amino substituted with lower alkyl or benzyl; and n is 1 or 2.

5. An electrophotographic element according to claim 4 wherein the amount of said carbazole derivative compound in the photosensitive layer is in the range of 10–95 wt.% and the amount of said charge carrier generating material in the photosensitive layer is in the range of 0.1–50 wt.%.

6. An electrophotographic element comprising an electrically conductive substrate and a photosensitive layer superposed thereon, wherein said photosensitive layer is a double layer that comprises a charge carrier generating sub-layer consisting essentially of a charge carrier generating material and a charge transfer layer containing a carbazole derivative compound having the following formula (I):

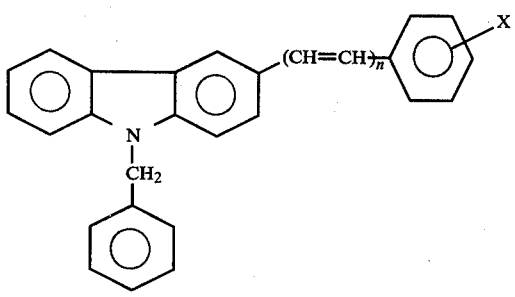

(I)

wherein X is hydrogen, lower alkyl, lower alkoxy, halogen, nitro, amino or amino substituted with lower alkyl or benzyl; and n is 1 or 2.

7. An electrophotographic element according to claim 6 wherein the amount of said carbazole derivative compound in the charge transfer sub-layer is in the range of 10–95 wt.%.

8. An electrophotographic element as claimed in claim 3 in which R is selected from the group consisting of $CH_3$, $C_2H_5$, $(CH_2)_2CH_3$, $CH(CH_3)_2$, $(CH_2)_3CH_3$ and $CH_2CH(CH_3)_2$, and X is selected from the group consisting of hydrogen, $CH_3$, $C_2H_5$, $(CH_2)_2CH_3$, $CH(CH_3)_2$, $(CH_2)_3CH_3$, $CH_2CH(CH_3)_2$, $CH(CH_3)CH_2CH_3$, $C(CH_3)_3$, $OCH_3$, $OC_2H_5$, $O(CH_2)_2CH_3$, $O(CH_2)_3CH_3$, $NH_2$, $N(CH_3)_2$, $N(C_2H_5)_2$,

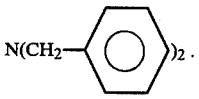

9. An electrophotographic element as claimed in claim 3 in which R is ethyl, n is 1 and X is selected from the group consisting of hydrogen, 4-$OC_2H_5$, 2-$CH_3$, 3-$CH_3$, 4-$NH_2$ and 4-$N(C_2H_5)_2$.

10. An electrophotographic element as claimed in claim 3 in which X is hydrogen.

11. An electrophotographic element as claimed in claim 1 in which R is selected from the group consisting of $CH_3$, $C_2H_5$, $(CH_2)_2CH_3$, $CH(CH_3)_2$, $(CH_2)_3CH_3$ and $CH_2CH(CH_3)_2$, and X is selected from the group consisting of hydrogen, $CH_3$, $C_2H_5$, $(CH_2)_2CH_3$, $CH(CH_3)_2$, $(CH_2)_3CH_3$, $CH_2CH(CH_3)_2$, $CH(CH_3)CH_2CH_3$, $C(CH_3)_3$, $OCH_3$, $OC_2H_5$, $O(CH_2)_2CH_3$, $O(CH_2)_3CH_3$, $NH_2$, $N(CH_3)_2$, $N(C_2H_5)_2$,

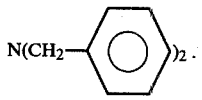

12. An electrophotographic element as claimed in claim 1 in which R is ethyl, n is 1 and X is selected from the group consisting of hydrogen, 4-$OC_2H_5$, 2-$CH_3$, 3-$CH_3$, 4-$NH_2$ and 4-$N(C_2H_5)_2$.

13. An electrophotographic element as claimed in claim 1 in which X is hydrogen.

14. An electrophotographic element as claimed in claim 4 in which X is selected from the group consisting of hydrogen, $CH_3$, $C_2H_5$, $(CH_2)_3CH_3$, $CH(CH_3)_2$, $CH_2CH(CH_3)_2$, $CH(CH_3)CH_2CH_3$, $C(CH_3)_3$, $OCH_3$, $OC_2H_5$, $O(CH_2)_2CH_3$, $O(CH_2)_3CH_3$, Cl, Br, $NO_2$, $NH_2$, $N(CH_3)_2$, $N(C_2H_5)_2$ and

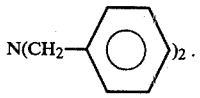

15. An electrophotographic element as claimed in claim 4 in which n is 1 and X is hydrogen.

16. An electrophotographic element as claimed in claim 6 in which X is selected from the group consisting of hydrogen, $CH_3$, $C_2H_5$, $(CH_2)_3CH_3$, $CH(CH_3)_2$, $CH_2CH(CH_3)_2$, $CH(CH_3)CH_2CH_3$, $C(CH_3)_3$, $OCH_3$, $OC_2H_5$, $O(CH_2)_2CH_3$, $O(CH_2)_3CH_3$, Cl, Br, $NO_2$, $NH_2$, $N(CH_3)_2$, $N(C_2H_5)_2$ and

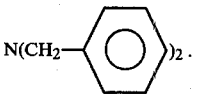

17. An electrophotographic element as claimed in claim 6 in which n is 1 and X is hydrogen.

18. An electrophotographic element according to claim 3 wherein the amount of said carbazole derivative compound in the photosensitive layer is in the range of 10–95 wt.% and the amount of said charge carrier generating material in the photosensitive layer is in the range of 0.1–50 wt.%.

* * * * *